US006671471B2

(12) United States Patent
Nakamura et al.

(10) Patent No.: US 6,671,471 B2
(45) Date of Patent: Dec. 30, 2003

(54) IMAGE HEATING APPARATUS

(75) Inventors: Naoki Nakamura, Boise, ID (US); Hitoshi Nishitani, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/077,941

(22) Filed: Feb. 20, 2002

(65) Prior Publication Data

US 2002/0118978 A1 Aug. 29, 2002

(30) Foreign Application Priority Data

Feb. 28, 2001 (JP) ..... 2001/055512
Mar. 7, 2001 (JP) ..... 2001/063193

(51) Int. Cl.[7] ..... G03G 15/20

(52) U.S. Cl. ..... 399/69; 219/216; 374/153; 399/320

(58) Field of Search ..... 399/69, 44, 94, 399/320, 328, 329, 107; 219/216, 471; 432/60; 374/153, 208, 141

(56) References Cited

U.S. PATENT DOCUMENTS 4,821,062 A * 4/1989 Katoh et al. ..... 219/216 X
5,299,870 A * 4/1994 Moritani ..... 374/153
5,366,291 A * 11/1994 Nakagama et al. ..... 374/153

FOREIGN PATENT DOCUMENTS

| | | |
|---|---|---|
| EP | 0 530 618 | 3/1993 |
| JP | 63-31382 | 2/1988 |
| JP | 05-223644 | 8/1993 |
| JP | 08-137328 | * 5/1996 |
| JP | 09-311079 | * 12/1997 |
| JP | 11-237806 | * 8/1999 |
| JP | 2000-305410 | * 11/2000 |
| JP | 2001-093653 | * 4/2001 |

* cited by examiner

*Primary Examiner*—Sophia S. Chen
(74) *Attorney, Agent, or Firm*—Fitzpatrick, Cella, Harper & Scinto

(57) ABSTRACT

An image heating apparatus in an image forming apparatus includes a temperature detecting element, an elastic member for pressuring the temperature detecting element and a film for covering the temperature detecting element. Conventionally, since the elastic member whose width is smaller than the width of the film completely covers the temperature detecting element and the elastic member, it has been necessary to prevent the film from interfering with and riding onto a heater holder equipped beside those parts. For improvement of the above problem, the elastic member whose width is larger than the width of the film is provided to be able to pressure an edge of the film.

12 Claims, 13 Drawing Sheets

IMAGE HEATING APPARATUS

BACKGROUND OF THE INVENTION

1. Field of the Invention

This invention relates to an image heating apparatus used in an image forming apparatus such as a laser printer or a facsimile apparatus using the electrophotographic process to fix an unfixed toner image on a recording medium such as a sheet by heat and pressure.

2. Related Background Art

An image forming apparatus using electrophotography according to the prior art is constructed as shown, for example, in FIG. 5 of the accompanying drawings. In FIG. 5, the reference numeral 201 designates a photosensitive drum, the reference numeral 202 denotes a charging roller, the reference numeral 203 designates a laser exposing apparatus, the reference numeral 204 denotes a reflecting mirror, the reference numeral 205 designates a developing sleeve, the reference numeral 206 denotes a toner, the reference numeral 207 designates a toner container, the reference numeral 208 denotes a transferring roller, the letter P designates a sheet as a recording medium, the reference numeral 210 denotes a cleaning blade, the reference numeral 211 designates a waste toner container, the reference numeral 212 denotes a fixing device, the reference numeral 213 designates a paper cassette, the reference numeral 214 denotes a sheet feeding roller, the reference numeral 215 designates a separating pad, and the reference numeral 216 denotes a high voltage source.

The epitome of the operation of the image forming apparatus will now be described. The photosensitive drum 201 is rotated in the direction of arrow, and is uniformly charged by the charging roller 202 supplied with electric power from the high voltage source 216. A laser beam emitted from the laser exposing apparatus 203 is reflected by the reflecting mirror 204, and thereafter is applied to the photosensitive drum 201, whereby an electrostatic latent image is formed on the photosensitive drum 201. The toner container 207 is filled with the toner 206, and with the rotation of the developing sleeve 205, a suitable amount of toner is subjected to moderate charging, and thereafter is supplied onto the photosensitive drum 201.

The toner 206 on the developing sleeve 205 adheres to the electrostatic latent image on the photosensitive drum 201, and the latent image is developed and visualized as a toner image. The sheet feeding roller 214 feeds the sheets P one by one from the paper cassette 213 in timed relationship with the formation of the toner image.

The separating pad 215 is disposed in abutting relationship with the sheet feeding roller 214, and the coefficient of friction, grounding angle and shape of the surface thereof are adjusted so as to feed only a recording medium during each sheet feeding time. The visualized toner image on the photosensitive drum 201 is transferred onto the sheet P by the transferring roller 208. Any untransferred toner not transferred but residual on the photosensitive drum 201 is collected into the waste toner container 211 by the cleaning blade 210, and the photosensitive drum 201 having had its surface cleaned enters the next image forming process.

Also, the sheet P now bearing the toner image thereon is heated and pressurized by the fixing device 212, whereby the toner image is permanently fixed on the sheet P.

The epitome of the fixing device 212 will now be described. A lengthwise schematic view of the fixing device 212 is shown in FIG. 6 of the accompanying drawings, and a cross-sectional view thereof taken along the line 7—7 of FIG. 6 is shown in FIG. 7 of the accompanying drawings. FIG. 8 is a lengthwise schematic view of a temperature detecting portion.

The fixing device 212, as shown in Japanese Patent Application Laid-Open No. 63-31382, uses a film heating process in which a pattern of a resistance heat generating member is provided on a ceramic substrate to thereby form a heat generating member and the heat generating member is used as a heater, which is caused to generate heat to thereby heat a sheet bearing an unfixed toner image thereon through thin film.

The reference numeral 108 designates a heater having a resistance heat generating member 108*a* formed on a ceramic substrate, and the resistance heat generating member 108*a* is coated with a glass layer 108*b* as a protective layer. The resistance heat generating member 108*a* is supplied with electric power by a power source, not shown, and generates heat. Temperature detecting means 117 abuts against the back of the heater 108 and detects the temperature of the heater 108. The temperature detecting means 117 is comprised of a temperature detecting element (ex. thermistor) 101, a heat-resistant elastic member 102 for elastically holding and pressuring the temperature detecting element 101, a frame 104 supporting the temperature detecting element 101 and the elastic member 102 and having a positioning shape for a heater holder 109, a metal 105 molded integrally with the frame 104 and electrically connected to the temperature detecting element 101, and a heat-resistant protective sheet 103 (film) for covering the temperature detecting element 101 and the elastic member 102 and positioned by the metal 105.

The temperature detecting element 101 is vertically movable by an amount corresponding to the expansion and contraction of the elastic member 102 with the aid of a groove formed in the frame 104. The temperature detecting means 117 is positioned by the heater holder 109 and is biased toward the heater 108 by a pair of springs 106. The reference numeral 107 denotes a spring supporting member. The amount of electric power supplied to the heater is controlled by a CPU, not shown, so that the detected temperature by the thermistor may become constant.

The heater holder 109 supports the heater 108 and is molded of heat-resistant resin such as PPS or liquid crystal polymer and serves also as a guide member for expediting the smooth rotation of fixing film 111.

A heater clip 114 and a heater connector 112 for supplying electricity to the heater nip the end portions of the heater 108 and the heater holder 109 therebetween. The fixing film 111 is cylindrical heat-resistant film of three-layer structure. The innermost layer of the fixing film 111 is a base layer, i.e., a layer bearing mechanical characteristics such as the torsion strength and smoothness of the fixing film 111, and is formed of resin such as polyimide.

The next layer is an electrically conducting primer layer, i.e., an electrically conducting layer having electrically conductive particles such as carbon black dispersed therein. The electrically conducting primer layer serves also as an adhesive effecting the joint of the third layer and the base layer. The outermost layer is a top layer and is designed to have an optimum resistance value and an optimum film thickness so as not to cause various bad images. The reference numeral 110 designates a fixing stay formed of a metal such as iron or aluminum. The fixing stay 110 serves to suppress the deformation of the heater holder 109 by creeping and enhance the rigidity of the heater holder 109. The reference numeral 113 denotes flanges mounted on the opposite end portions of the fixing stay 110.

The heater 108, the heater holder 109 and the fixing film 111 fitted on the fixing stay 110 are located between the flanges 113 on the axially opposite end portions and are subjected to lengthwise regulation. The above-described assembly is a film unit.

The reference numeral 119 designates a pressure roller. The pressure roller 119 comprises a mandrel 119*a* made of aluminum or cast iron and covered with heat-resistant rubber 119*b* such as silicone rubber. The surface layer of the rubber 119*b* of the pressure roller 119 is provided with film of fluorine resin such as PFA, PTFE or FEP having a releasing property with respect to the toner. The pressure roller 119 has its axially opposite end portions rotatably journalled between the side plates of the heating apparatus, not shown. The aforedescribed film unit is opposed to the upper side of the pressure roller 119 so that the heater 108 may face downward, and the flanges 113 mounted on the fixing stay 110 are downwardly urged by pressure springs 116 to thereby form a fixing nip N.

The pressure roller mandrel 119*a* of the pressure roller 119 is rotatively driven by a pressure roller gear 115, and the fixing film 111 is driven to rotate in the fixing nip part N. The sheet P bearing the toner thereon is conveyed by the transferring roller 208 and the photosensitive drum 201 and is guided to the fixing nip part N by a fixing inlet guide 118. The toner T on the sheet P is pressed against the recording medium P and heated in the fixing nip part N, and the toner T is softened and closely adhereto to the sheet P and is permanently fixed. A heating member of low heat capacity can be used in the fixing apparatus of such a film heating type and therefore, as compared with the conventional heat roller type, the shortening of the waiting time (quick start) becomes possible. Also, by the quick start becoming possible, preliminary heating during the non-printing operation becomes unnecessary and overall saving of electric power can be achieved.

The prior-art heating apparatus, however, has suffered from the following problem.

In the conventional temperature detecting means 117, the protective sheet 103 has been of a shape completely covering the temperature detecting element 101 and the elastic member 102.

Accordingly, in order that the temperature detecting element 101 may reliably abut against the heater 108 with the protective sheet 103 interposed therebetween, it has been necessary to sufficiently secure a gap G3 between the protective sheet 103 and the heater holder 109, as shown in FIG. 8, to prevent the protective sheet 103 from interfering with and riding onto the hole 109*a* of the heater holder 109.

On the other hand, if the gap G3 becomes great, when the heater 108 generates heat, a temperature difference between a portion in which members (the heater holder 109 and the protective sheet 103) abutting against the upper surface side of the heater 108 are present and a portion (gap G3) in which they are absent, and an internal stress difference applied to the interior of the heater 108 becomes great, and this has caused the damage of the heater 108 in some cases.

Also, FIGS. 12A to 12D of the accompanying drawings show a fixing device having another conventional temperature detecting device mounted thereon, FIG. 12A being a plan view, FIG. 12B showing the free state of the temperature detecting device, FIG. 12C being a cross-sectional view taken along the line 12C—12C of FIG. 12A, and FIG. 12D being a cross-sectional view taken along the line 12D—12D of FIG. 12C.

In FIGS. 12A to 12D, the conventional temperature detecting device has a heat-resisting elastic member 2 provided with a temperature detecting element 1 on the underside thereof mounted on a temperature detecting element holding member 33 with a temperature detecting element holding surface 33*a* adjusted thereto, and the temperature detecting element holding member 33 is mounted on a positioning member 34 through two electrically insulated leaf springs 35*a* and 35*b* serving also as the lead wires of the temperature detecting element 1.

The positioning member 34 is formed with a slot-shaped positioning hole 34*a* and a circular positioning hole 34*b*. Also, harness 7 connected to the leaf springs 35*a* and 35*b* is drawn out of the positioning member 34, and is connected to a CPU.

The reference numeral 39 denotes a heating member holding member which is integrally formed with positioning projections 39*a* and 39*b* fitted in the positioning holes 34*a* and 34*b* of the positioning member 34. Also, the heating member holding member 39 is formed with a hole portion 39*c* so that the temperature detecting element 1 can contact with the ceramic substrate of the heating member 8 exposed in the hole portion 39*c*.

The temperature detecting device in its natural state, as shown in FIG. 12B, is such that the leaf springs 35*a* and 35*b* are bent midway thereof and the temperature detecting element holding member 33 is in its downwardly facing posture, and is designed such that by the positioning member 34 being mounted on the heating member holding member 39, the pressure of the surface of contact between the temperature detecting element 1 and the heating member 8 is applied thereto by the resilient deformation of the leaf springs 35*a* and 35*b*.

Also, the positioning member 34 is designed such that the radial position of the positioning member 34 is determined by the fitting between the positioning holes 34*a*, 34*b* and the projections 9*a*, 9*b*, and the thrust direction of the positioning member 34 is fixed and held by a fixing member, not shown.

As shown in FIGS. 12A to 12D, the temperature detecting device is positioned relative to the heating member holding member 39 and the heating member 8 by the positioning member 34, and is connected to the temperature detecting element holding member 33 with the leaf springs 35*a* and 35*b*, and is designed such that the contact pressure between the temperature detecting element and the heating member is ensured by the action of the bending stress of the leaf springs.

FIG. 13 of the accompanying drawings schematically shows the relation between the contact pressure and the detected temperature, and the axis of abscissas is indicative of the contact pressure and the axis of ordinates is indicative of the output of the temperature detecting element, and the shown graph graphically shows changes in the output when the contact pressure has been changed when the temperature is constant.

As shown, when the contact pressure is changed, the result of the detection has a characteristic of changing and therefore, actually, the shown range in which the gradient is small is a utilizable range, but the gradient is never 0, but it is an important design task leading to accurate temperature detection, and further to the higher speed of response and the optimization of temperature control to more stabilize the contact pressure.

SUMMARY OF THE INVENTION

The present invention has been made in view of the above-noted problems and an object thereof is to provide an image heating apparatus in which the abutting state of a temperature detecting element against a heater is optimum.

Another object of the present invention is to provide an image heating apparatus which is excellent in the accuracy of temperature detection.

Still another object of the present invention is to provide an image heating apparatus comprising:

a heater; and temperature detecting means for detecting the temperature of the heater, the temperature detecting means having a temperature detecting element, an elastic member holding the element and film covering the elastic member;

the width of the film being smaller than the width of the elastic member.

Yet still another object of the present invention is to provide an image heating apparatus comprising:

a heater;

a holder for holding the heater; and temperature detecting means for detecting the temperature of the heater, the temperature detecting means having a temperature detecting element and a supporting member for holding the element;

wherein the temperature detecting element detects the temperature of the heater through a hole formed in the holder, and the holder has positioning portions for positioning the supporting member at the right and left of the hole of the holder.

Further objects of the present invention will become apparent from the following detailed description when read with reference to the accompanying drawings.

DESCRIPTION OF THE PREFERRED EMBODIMENTS

First Embodiment

Figure 1:
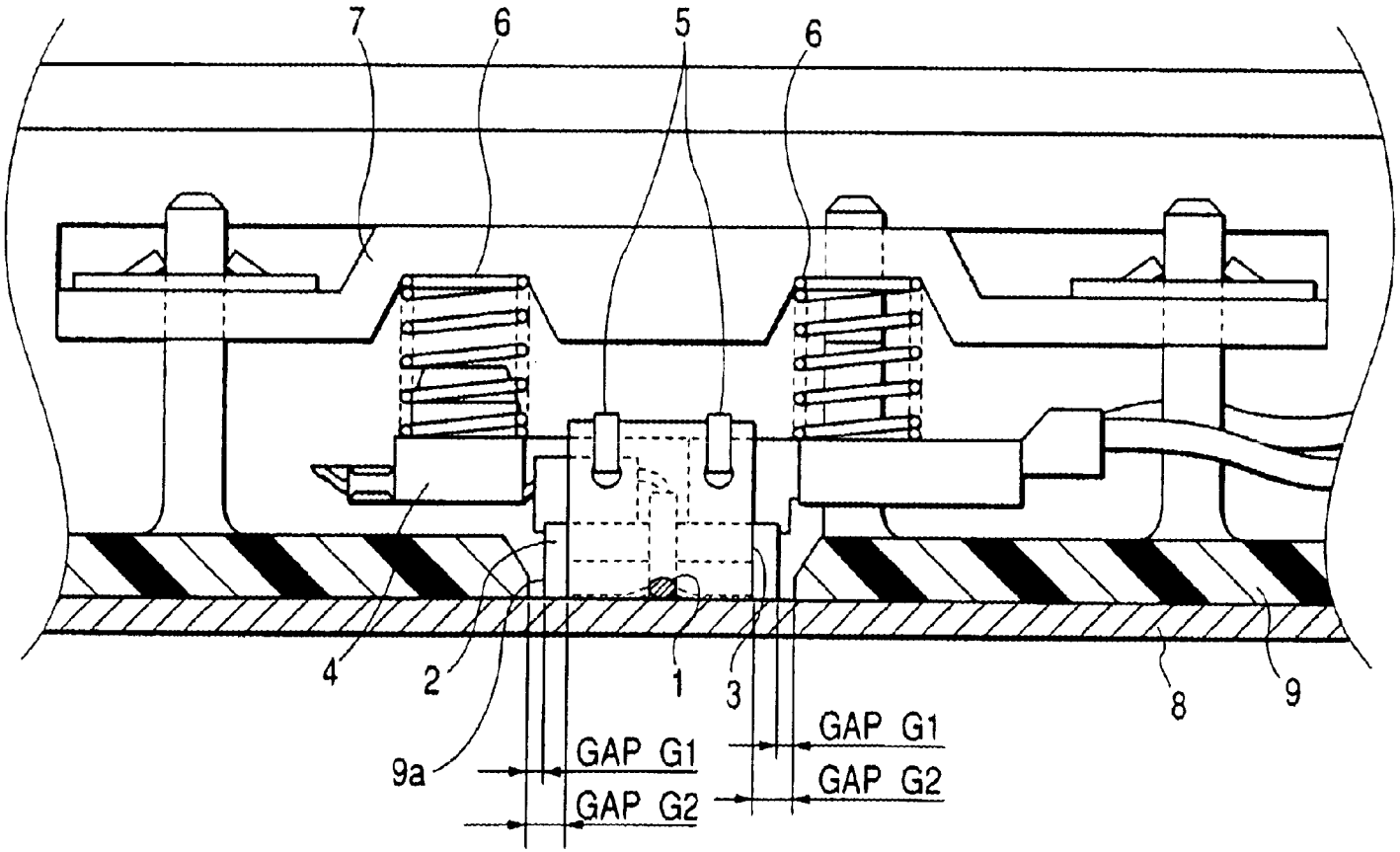
FIG. 1 is a cross-sectional view of an image heating apparatus according to Embodiment 1 showing the left to right of the figure so as to be the lengthwise direction of a heater, and particularly shows a temperature detecting portion and the surroundings thereof.

FIG. 1 shows temperature detecting means mounted on a heating apparatus according to Embodiment 1. This heating apparatus is similar to that in the image forming apparatus according to the prior art except for the temperature detecting means.

Means for detecting the temperature of a heater 8 is comprised of a temperature detecting element (thermistor) 1, a heat-resistant elastic member 2 for elastically holding the temperature detecting element 1, a frame (supporting member) 4 supporting the temperature detecting element 1 and the elastic member 2 and having a positioning shape relative to a heater holder 9, a metal 5 molded integrally with the frame 4 and electrically connected to the temperature detecting element 1, and a heat-resistant protective sheet (film) 3 covering the temperature detecting element 1 and the elastic member 2 and positioned by the metal 5.

The temperature detecting element 1 is vertically movable by an amount corresponding to the expansion and contraction of the elastic member 2 with the aid of a groove formed in the frame 4. The temperature detecting means is positioned by the heater holder 9 and is biased toward the heater 8 by a keep spring 6. The reference numeral 7 designates a keep spring supporting member. The amount of electric power supplied to the heater is controlled by a CPU so that the detected temperature by the thermistor may become constant.

In order that the temperature detecting element 1 may reliably abut against the heater 8 with the protective sheet 3 interposed therebetween, the protective sheet 3 must be prevented from interfering with the hole 9*a* of the heater holder 9 and riding thereonto.

Accordingly, the gap G2 between the protective sheet 3 and the heater holder 9 is sufficiently secured in compliance with size tolerance variations of the protective sheet 3 as a part before assembly and an assembled part after assembly.

On the other hand, the end portion of the elastic member 2 can absorb the aforementioned interference by the elasticity of the elastic member 2 even when the elastic member 2 and the heater holder 9 interfere with each other and therefore, the gap G1 between the elastic member 2 and the heater holder 9 is made sufficiently smaller than the aforementioned gap G2.

Accordingly, the positional relationship between the elastic member 2 and the protective sheet 3 is such that the elastic member 2 is exposed from the protective sheet 3. That is, the width of the protective sheet (film) 3 is smaller than the width of the elastic member 2.

As described above, in Embodiment 1, the elastic member 2 constituting the thermistor is exposed from the protective sheet 3, and this leads to effect shown below.

Firstly, the gap G2 between the protective sheet 3 and the hole 9*a* of the heater holder 9 can be sufficiently secured and therefore, the temperature detecting element 1 reliably abuts against the heater 8 and the reliability of the detected temperature is improved.

Secondly, it is possible to minimize the gap G1 between the elastic member 2 and the hole 9*a* of the heater holder 9 by utilizing the elasticity of the elastic member 2. Accordingly, when the heater 8 generates heat, the change in the temperature of the heater 8 is mitigated in a portion wherein members (the heat holder 9 and the protective sheet 3) abutting against the upper surface side of the heater 8 are present and a portion (the gap G1) wherein they are absent, and an internal stress difference applied to the interior of the heater 8 becomes small and therefore, there can be provided a heating apparatus excellent in reliability.

Second Embodiment

Figure 2:
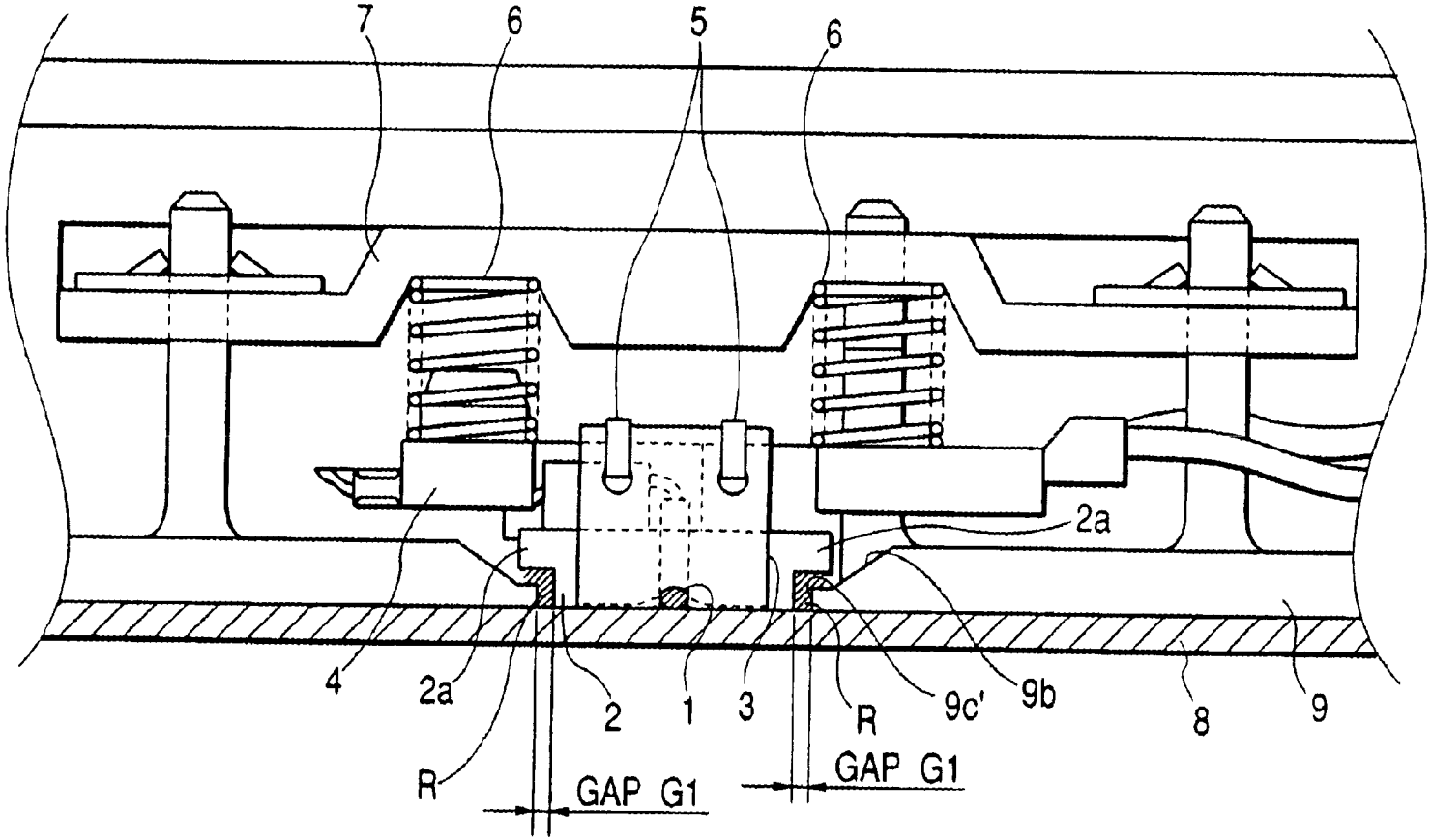
FIGS. 2 and 3 are cross-sectional views of an image heating apparatus according to Embodiment 2.

FIG. 2 shows temperature detecting means mounted on a heating apparatus according to Embodiment 2. This embodiment is similar to Embodiment 1 except for the elastic member 2.

In Embodiment 2, in addition to the construction of Embodiment 1, i.e., exposing the elastic member 2 from the protective sheet 3, the heater holder 9 is formed with an inclined surface 9*b* inclined toward the hole 9*a*, and a flat surface 9*c*' connecting to the inclined surface 9*b*, as shown in FIG. 2.

Also, this elastic member 2 is formed with overhanging portions 2*a* protruding toward the inclined surface 9*b* in the upper portion thereof. Accordingly, the size of the elastic member 2 in the lengthwise direction of the heater is larger than that of the hole 9*a* of the heater holder 9.

In the present embodiment, when the heater 8 generates heat, the elastic member 2 and the heater holder 9 overlap each other in the vertical direction and therefore, the overlapping portion functions as an adiabatic layer R by radiant heat.

Accordingly, the change in the temperature of the heater 8 is more mitigated than in the construction shown in Embodiment 1, and the internal stress difference applied to the interior of the heater 8 becomes smaller.

Figure 3:
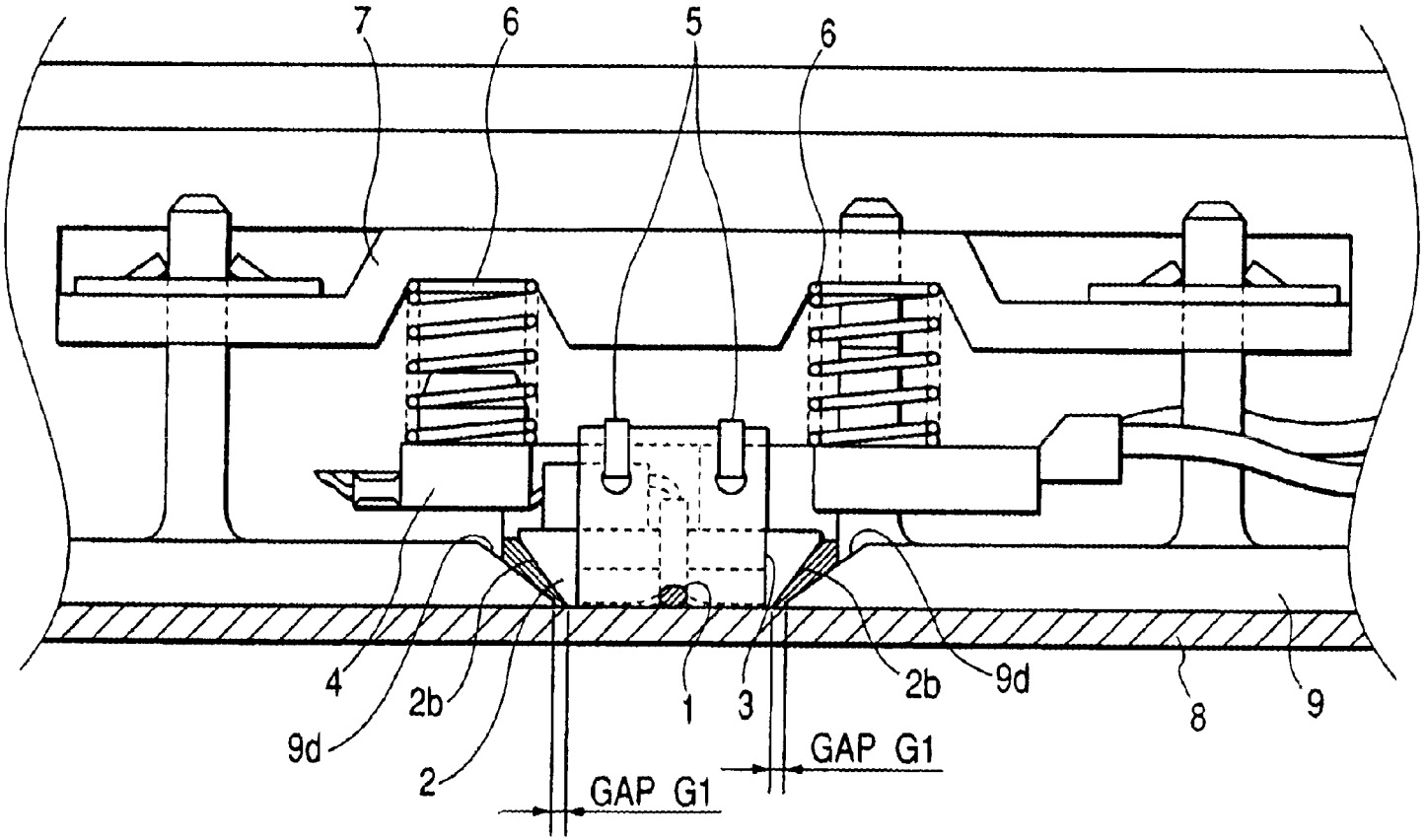

While in Embodiment 2, the end portion of the elastic member 2 is of a staircase shape, as shown in FIG. 3, provision may be made of such an inclined surface portion 2*b* as becomes wider toward the lengthwise direction of the heater as the end portion of the elastic member 2 goes away from the heater 8 (goes upwardly as viewed in FIG. 3), and the hole 9*a* of the heater holder 9 may be provided with an inclined surface portion 9*d*, and again in this case, the size of the elastic member 2 in the lengthwise direction of the heater is larger than that of the hole 9*a* of the heater holder 9.

As described above, in the construction of Embodiment 2, when the heater 8 generates heat, the adiabatic layer R is formed in the portion wherein the elastic member 2 and the hole 9*a*' of the heater holder 9 overlap each other and therefore, in the portion wherein the members (the heater holder 9 and the protective sheet 2) abutting against the upper surface side of the heater 8 are present and the portion (the gap G1) wherein they are absent, the change in the temperature of the heater 8 is more mitigated than in Embodiment 1, and the internal stress difference applied to the interior of the heater 8 becomes smaller and therefore, there can be provided a heating apparatus excellent in reliability.

Third Embodiment

Figure 4:
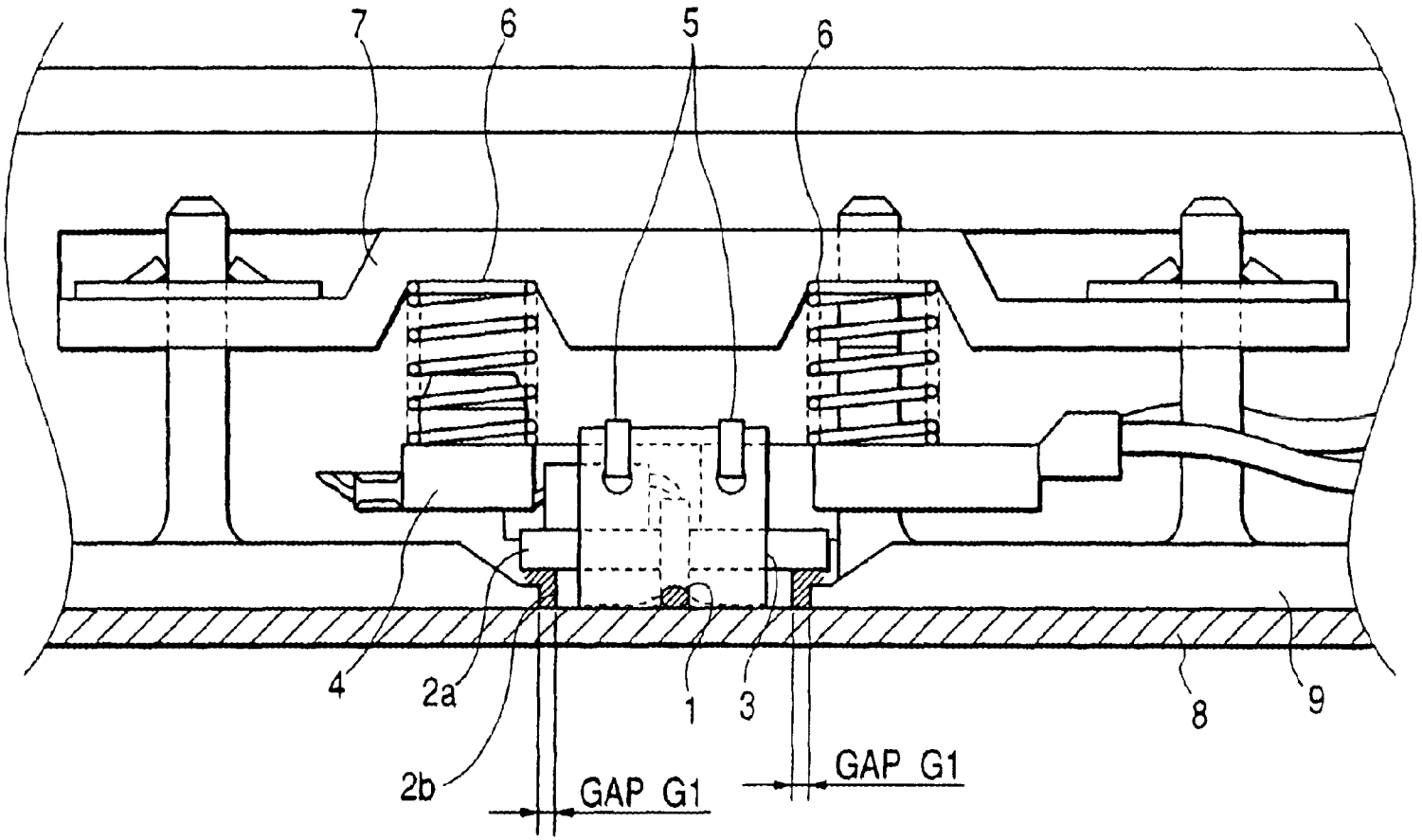
FIG. 4 PRIOR ART
FIG. 4 is a cross-sectional view of an image heating apparatus according to Embodiment 3.
Figure 5:
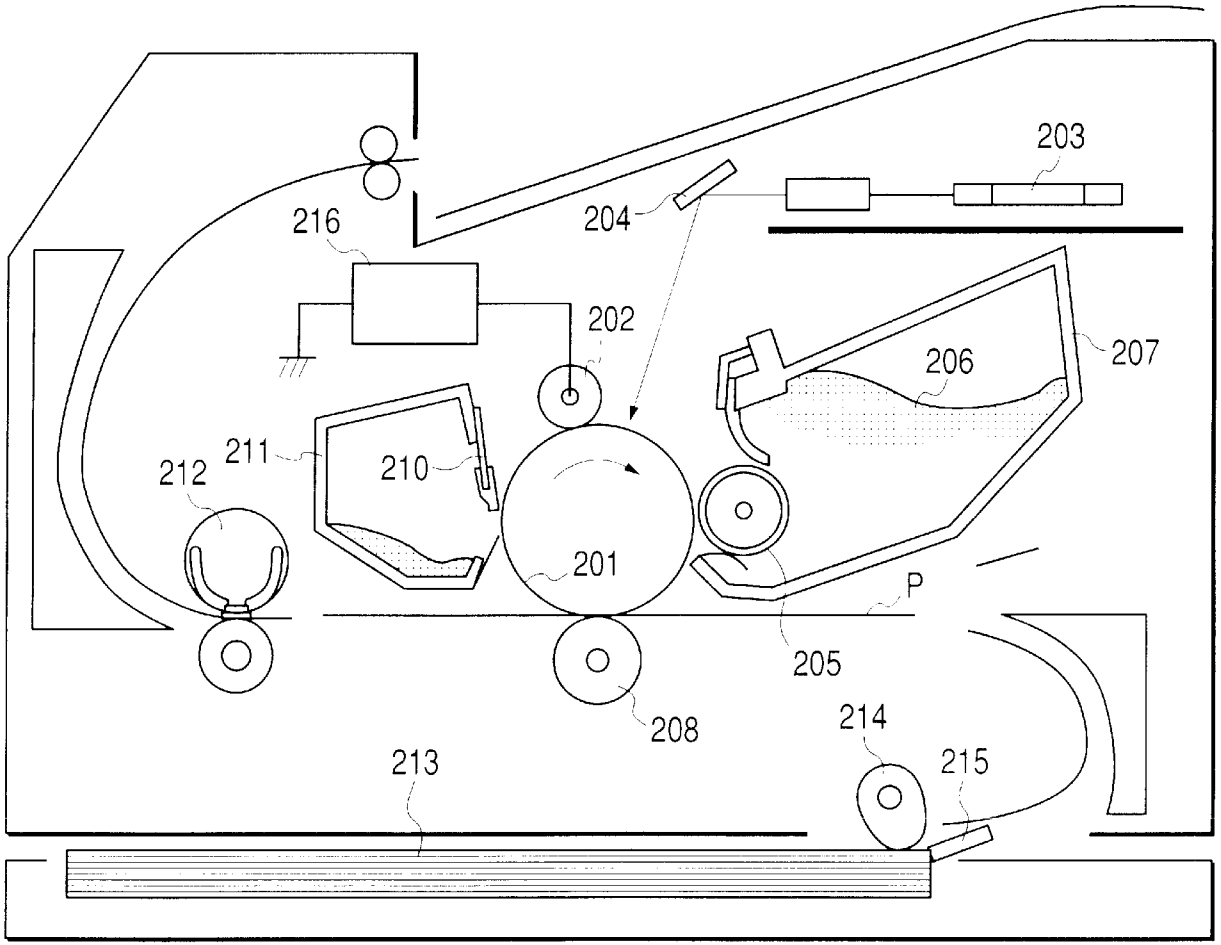
FIG. 5 is a cross-sectional view of an image forming apparatus to which the image heating apparatus of the present invention is applied.
Figure 6:
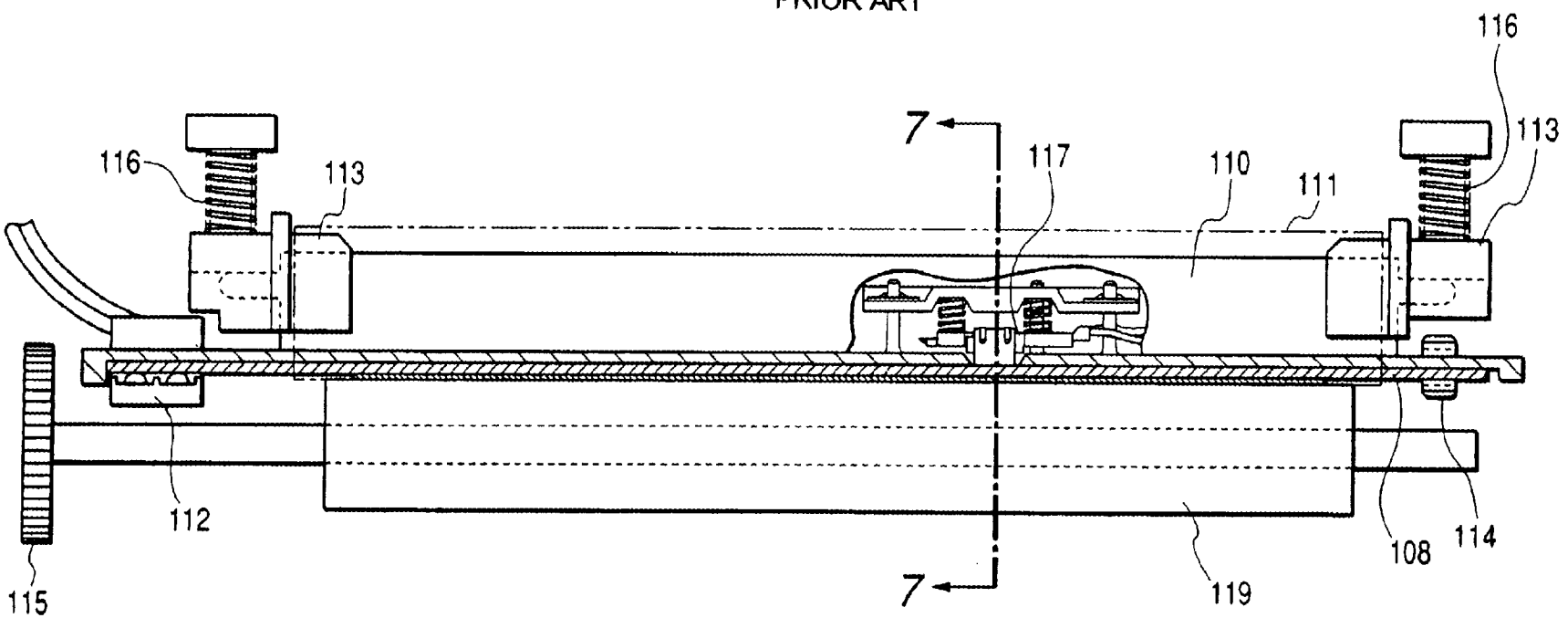
FIG. 6 PRIOR ART
FIG. 6 is a cross-sectional view of an image heating apparatus according to the prior art.
Figure 7:
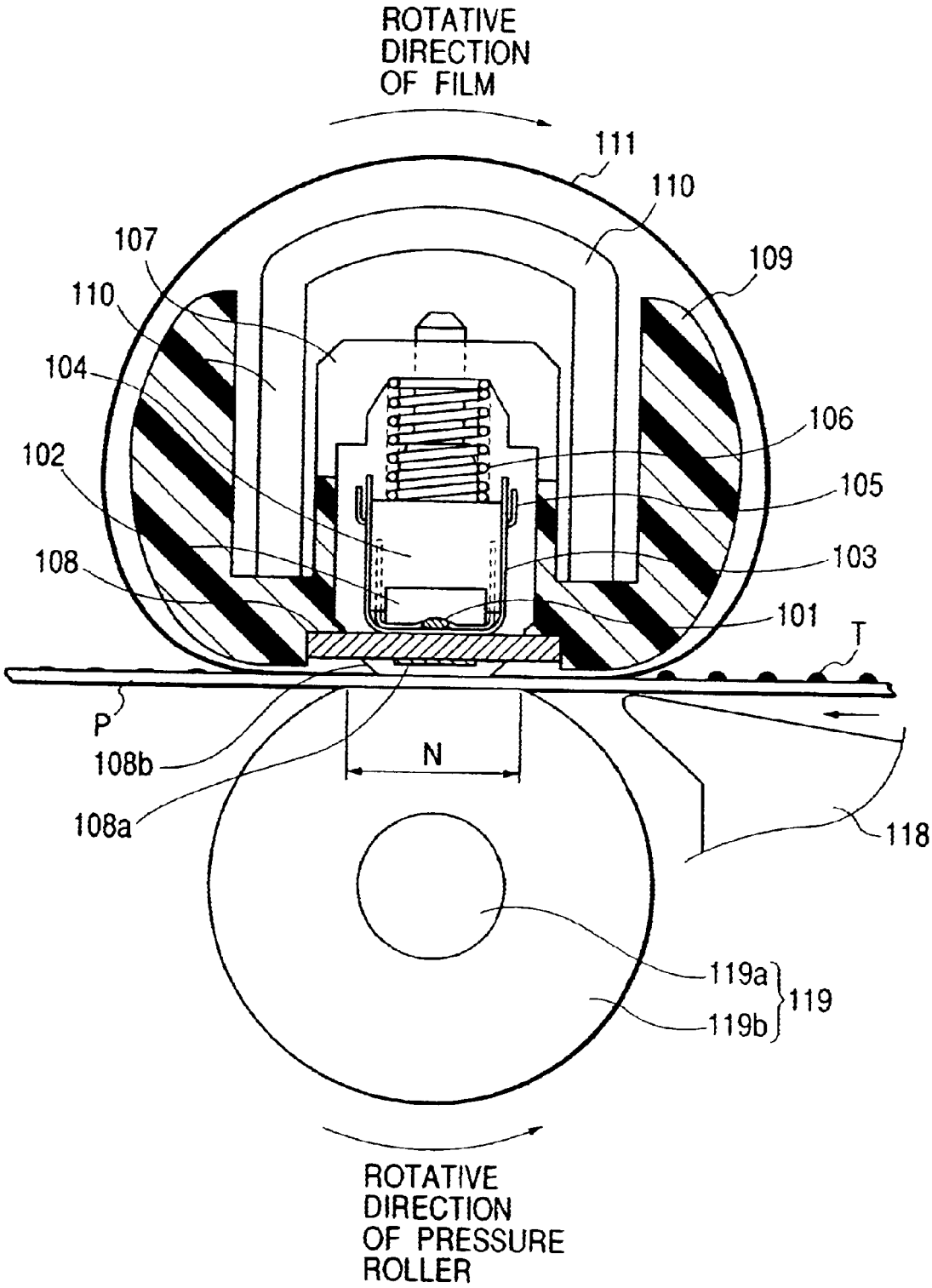
FIG. 7 PRIOR ART
FIG. 7 is a cross-sectional view taken along the line 7—7 of FIG. 6.
Figure 8:
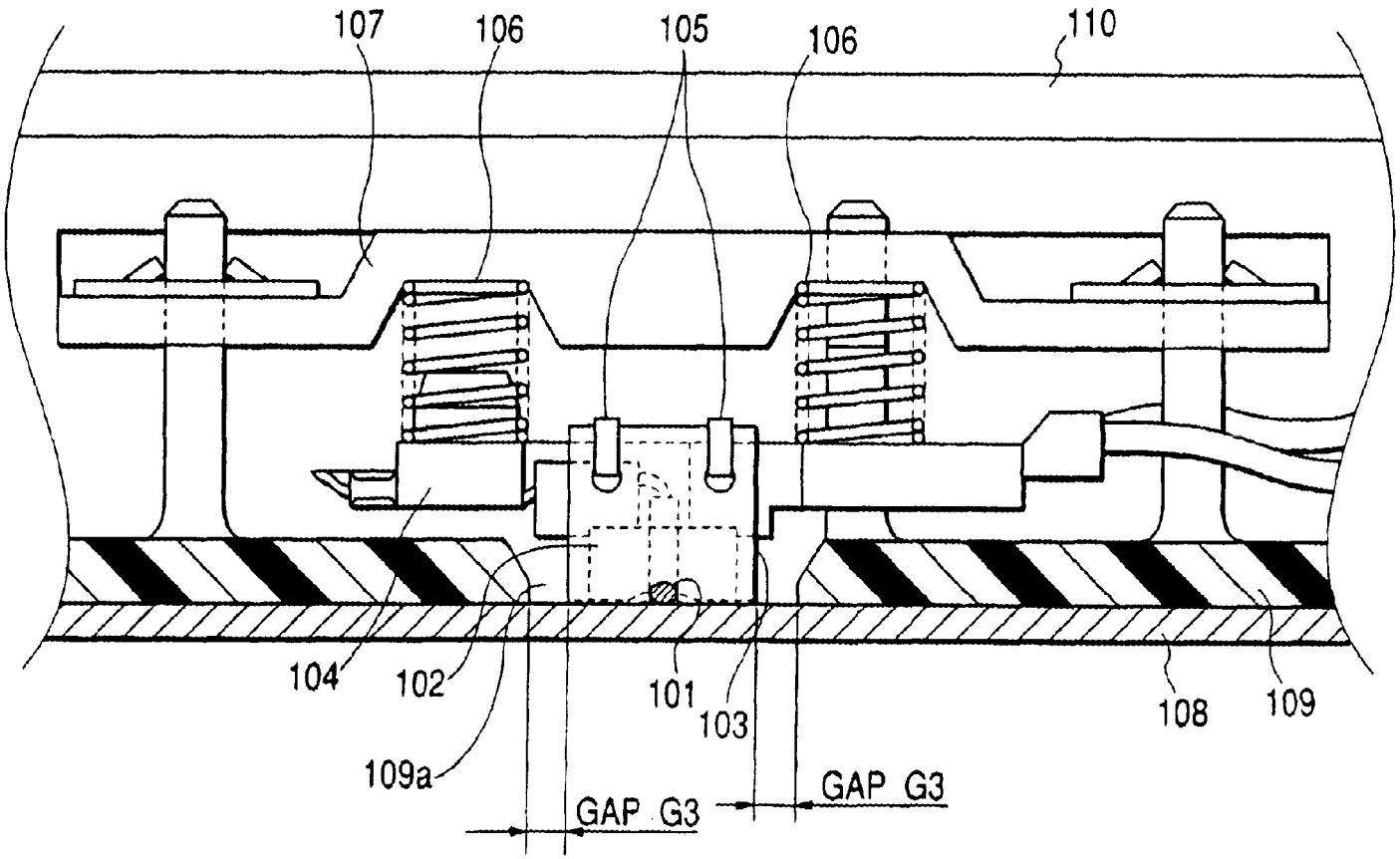
FIG. 8 PRIOR ART
FIG. 8 is a cross-sectional view of the temperature detecting portion of the image heating apparatus shown in FIG. 6 and the surroundings thereof.

FIG. 4 shows temperature detecting means mounted on a heating apparatus according to Embodiment 3. This embodiment is similar to Embodiment 1 and Embodiment 2 except for the elastic member 2.

In the construction of Embodiment 2, provision is made of such a staircase shape as becomes wider as the end portion of the elastic member 2 goes away from the heater holder 9, and the size of the elastic member 2 in the lengthwise direction of the heater is made larger than that of the hold 9*a* of the heater holder 9. In that case, to make the elastic member 2 into a staircase shape, it is necessary to effect secondary working such as cutting on the elastic member 2, and this has led to the problem of a higher cost.

Accordingly, in the present embodiment, a second elastic member 2*b* shorter in the length thereof in the lengthwise direction of the heater than a first elastic member 2*a* long in the lengthwise direction of the heater is made to overlap the lower portion of the first elastic member 2*a* to thereby obtain the staircase shape of the end portion of the elastic member 2 similar to that in Embodiment 2.

As described above, in Embodiment 3, the elastic member 2 of which the end surface is of a staircase shape as shown in Embodiment 2 is formed by the elastic members 2*a* and 2*b* constituted by two rectangular parallelepipeds being made to overlap each other, whereby it becomes unnecessary to effect the secondary working of the elastic member 2.

Accordingly, in addition to the effects shown in Embodiment 2, there can be provided a heating apparatus inexpensive for users.

Fourth Embodiment

Figure 9A:
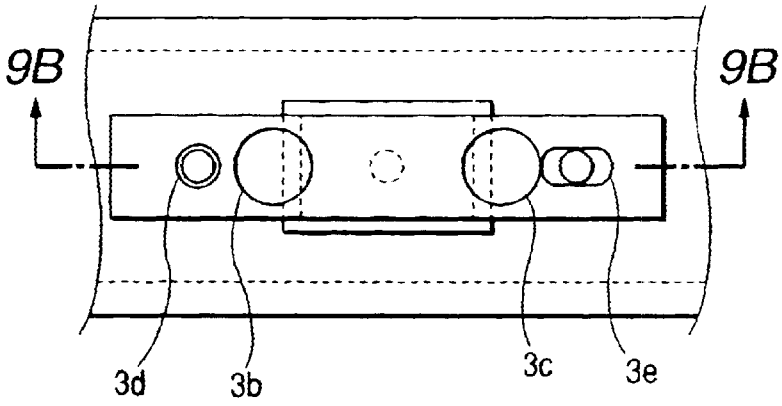
FIGS. 9A, 9B and 9C show a heating and fixing apparatus in which a temperature detecting device in a fourth embodiment of the present invention is mounted on a heating member holding member, FIG. 9A being a plan view, FIG. 9B being a cross-sectional view taken along the line 9B—9B of FIG. 9A, and FIG. 9C being a cross-sectional view taken along the line 9C—9C of FIG. 9B.
Figure 9B:
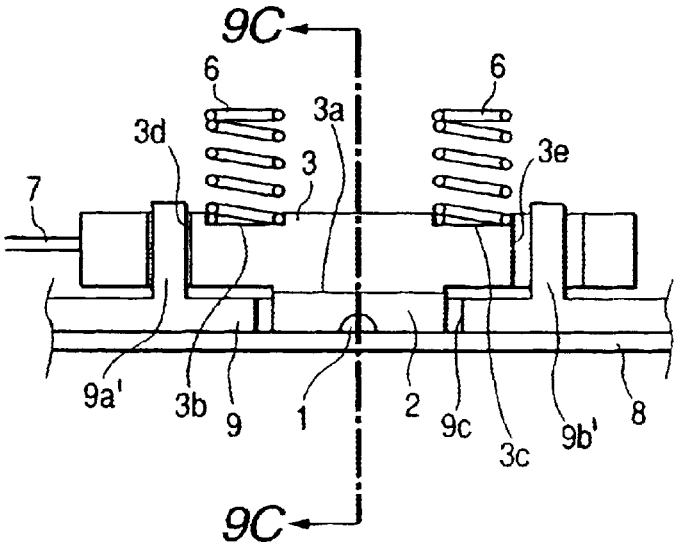
Figure 9C:
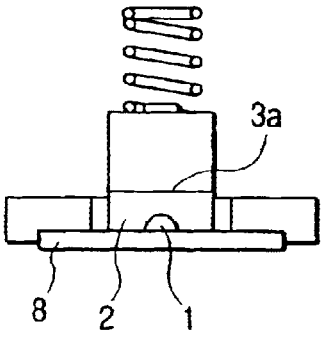

FIGS. 9A to 9C show a fourth embodiment of the present invention.

FIGS. 9A to 9C show a heating and fixing apparatus in which a temperature detecting apparatus is mounted on a heating member holding member, FIG. 9A being a plan view, FIG. 9B being a cross-sectional view taken along the line 9B—9B of FIG. 9A, and FIG. 9C being a cross-sectional view taken along the line 9C—9C of FIG. 9B.

In FIGS. 9A to 9C, the reference numeral 1 designates a temperature detecting element, the reference numeral 2 denotes a heat-resisting elastic member, the reference numeral 3 designates a temperature detecting element holding member (supporting member), the reference character 3*a* denotes a temperature detecting element holding surface, the reference characters 3*b* and 3*c* designate spring receiving surfaces, the reference characters 3*d* and 3*e* denote positioning holes, the reference numeral 6 designates compression springs, the reference numeral 7 denotes harness, the reference numeral 8 designates a heating member, the reference numeral 9 denotes a heating member holding member (holder), and the reference characters 9*a* and 9*b* designate projections for positioning the temperature detecting element holding member. In the plan view, the compression springs are omitted.

In FIGS. 9A to 9C, the temperature detecting device is such that the heat-resisting elastic member 2 having the temperature detecting element 1 on the underside thereof is mounted on the temperature detecting element holding surface 3*a* provided on the lower end portion of the temperature detecting element holding member 3, the circular positioning hole 3*d* and the slot-like positioning hole 3*e* are formed in the lengthwisely opposite end portions of the temperature detecting element holding member 3, and the spring receiving surfaces 3*b* and 3*c* to which the lower end portions of the compression springs 6 are fitted and formed on the upper end surface inward of the positioning holes 3*d* and 3*e*. Also, the temperature detecting element holding member 3 is such that the harness 7 connected to the temperature detecting element 1 extends outwardly from the other end thereof.

Also, the heating member holding member 9 is formed with the positioning projections 9*a* and 9*b* to be fitted in the positioning holes 3*d* and 3*e* of the temperature detecting element holding member 3, and when the projections 9*a* and 9*b* are fitted in these positioning holes 3*d* and 3*e*, respectively, the heat-resisting elastic member 2 fits into a through-hole 9*c* for exposing the heating member 8 therethrough, and the temperature detecting element 1 comes into contact with the heating member 8. In FIG. 9A, the compression springs 6 is omitted.

The temperature detecting device is designed such that the radial positions of the positioning projections 9*a* and 9*b* are determined by the fitting of the projections 9*a* and 9*b* into the positioning holes 3*d* and 3*e*, and the upper ends of the compression springs 6 (the sides thereof opposite to the sides thereof biasing the temperature detecting device) are fixed by fixing members, not shown, and the compressing springs 6 are held with a predetermined action length, whereby the position of the temperature detecting device in the thrust direction thereof is determined.

Also, in the present embodiment, the compression springs 6 are deposed substantially symmetrically in the lengthwise direction with respect to the temperature detecting element 1 in order to make the pressure balance of the contact pressure on the contact surface uniform.

As shown in FIGS. 9A to 9C, according to the fourth embodiment of the present invention, the holder 9 has the positioning portions 9*a* and 9*b* for positioning the supporting member 3 at the left and right of the hole 9*c* and therefore, the accuracy of the mounting of the temperature detecting portion onto the heater is improved. Also, the positions substantially symmetrical in the lengthwise direction of the heater about the temperature detecting element 1 are directly biased from the back side of the temperature detecting device by the compression springs, and this leads to the obtainment of the effect that the contact pressure between the temperature detecting element 1 and the heating member 8 is stabilized.

Also, instead of the construction according to the prior art in which the temperature detecting element holding portion and the positioning portion are connected together by the leaf spring, the positioning holes are formed in the temperature detecting element holding portion and therefore, the accuracy of the positioning of the heating member and the heating member holding member can be improved. As the result, as compared with the example of the prior art, the accuracy of temperature detection can be improved. Since the positional accuracy is improved, the non-contact surface of the heating member in the through-hole portion can be set narrowly as compared with the example of the prior art, and it is difficult for the damage of the heating member due to the unevenness of fixing and heating and thermal stress to occur.

Also, while in the present embodiment, the positioning region has its temperature detecting element holding member side depicted as a hole and its heating member holding member depicted as a projection, a similar effect will of course be obtained even if the temperature detecting element holding member side is a projection and the heating member holding member side is a hole.

Also, while the present embodiment has been described with respect to an example in which a temperature detecting device is provided for a fixing and heating apparatus, even a fixing and heating apparatus of a form in which two or more temperature detecting devices are provided for a fixing and heating apparatus and the temperatures of different portions are detected to thereby effect temperature adjustment and control has the effect of stabilizing the temperature detection accuracy of respective portions if the present invention is applied thereto, and this is effective.

Further, even when two or more temperature detecting devices are provided, it will be effective as the entire fixing and heating apparatus even if the temperature detecting device of the present invention is used only in a portion wherein accuracy is particularly necessary or a portion which is dimensionally limited and the conventional temperature detecting device is used in the other portion.

Also, if the accuracy of detection is sufficiently uniform, the degree of symmetry of the spring disposition and the number of the springs can be ignored.

Fifth Embodiment

Figure 10A:
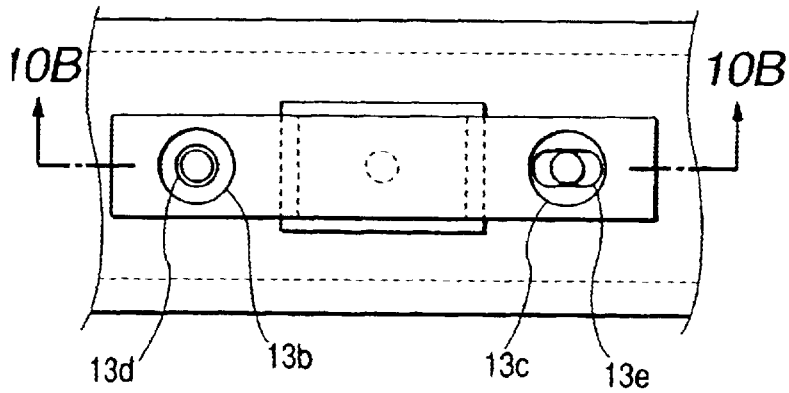
FIGS. 10A, 10B and 10C show a heating and fixing apparatus in which a temperature detecting device in a fifth embodiment of the present invention is mounted on a heating member holding member, FIG. 10A being a plan view, FIG. 10B being a cross-sectional view taken along the line 10B—10B of FIG. 10A, and FIG. 10C being a cross-sectional view taken along the line 10C—10C of FIG. 10B.
Figure 10B:
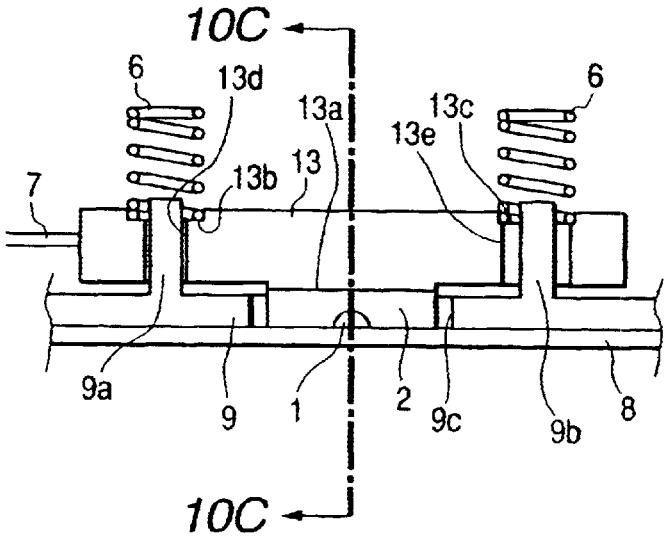
Figure 10C:
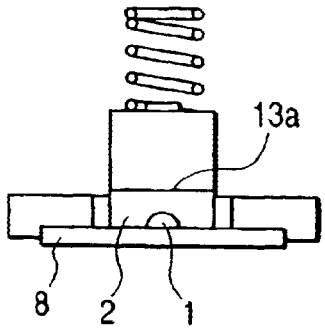

FIGS. 10A to 10C show a fifth embodiment of the present invention. FIGS. 10A to 10C show a heating and fixing apparatus in which a temperature detecting device is mounted on a heating member holding member, FIG. 10A being a plan view, FIG. 10B being a cross-sectional view taken along the line 10B—10B of FIG. 10A, and FIG. 10C being a cross-sectional view taken along the line 10C—10C of FIG. 10B.

In FIGS. 10A to 10C, the reference numeral 1 designates a temperature detecting element, the reference numeral 2 denotes a heat-resisting elastic member, the reference numeral 13 designates a temperature detecting element holding member, the reference character 13*a* denotes a temperature detecting element holding surface, the reference characters 13*b* and 13*c* designate spring receiving surfaces, the reference characters 13*d* and 13*e* denote positioning holes, the reference numerals 5 and 6 designate compression springs, the reference numeral 7 denotes harness, the reference numeral 8 designates a heating member, the reference numeral 9 denotes a heating member holding member, and the reference characters 9*a* and 9*b* designate projections for positioning the temperature detecting element holding member. In the plan view, the compression springs are omitted.

The difference of the present embodiment from the above-described fourth embodiment is that the compression springs 5 and 6 are disposed coaxially with the projections 9*b* and 9*a,* and the spring receiving surfaces 13*c* and 13*b* are formed around the positioning holes 13*e* and 13*d,* respectively.

In the present embodiment, the temperature detecting device is similar to that in the fourth embodiment in that the radial positions of the positioning projections are determined by the fitting of the projections into the positioning holes, the upper ends of the compression springs (the sides thereof opposite to the sides biasing the temperature detecting element holding member 13) are fixed by fixing members, not shown, and the compression springs 5 and 6 are held with a predetermined action length, whereby the position of the temperature detecting device in the thrust direction thereof is determined.

The centers of the compression springs 5 and 6 and the centers of the positioning holes 13*e* and 13*d* are made coincident with each other to prevent the static friction between the positioning holes and the positioning projections and the biasing force of the compression springs from balancing with each other and the temperature detecting device from stopping midway without descending to a predetermined position, and prevent the temperature detecting device, if it does not stop midway, from losing the biasing force of the compression springs by the static frictional force, and the point at which the biasing force of the springs acts and the point at which the static friction between the holes and the projections occurs are thus made coincident with each other, whereby the inconvenience as previously described can be prevented as far as possible.

As shown in FIGS. 10A to 10C, according to the fifth embodiment of the present invention, the centers of the positioning holes and the compression springs are made coincident with each other, and the influence of the friction between the positioning holes and the projections is minimized, whereby there is obtained the effect that the contact pressure between the temperature detecting element and the heating member is stabilized, and as compared with the fourth embodiment, the accuracy of temperature detection can be further improved.

Sixth Embodiment

Figure 11A:
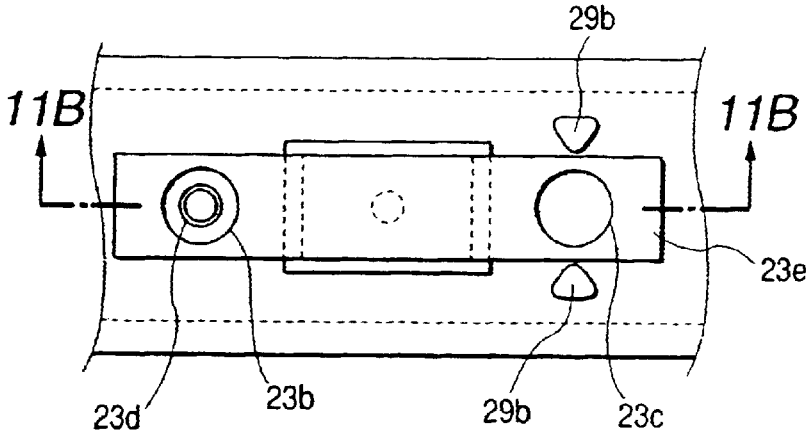
FIGS. 11A, 11B and 11C show a heating and fixing apparatus in which a temperature detecting device in a sixth embodiment of the present invention is mounted on a heating member holding member, FIG. 11A being a plan view, FIG. 11B being a cross-sectional view taken along the line 11B—11B of FIG. 11A, and FIG. 11C being a cross-sectional view taken along the line 11C—11C of FIG. 11B.
Figure 11B:
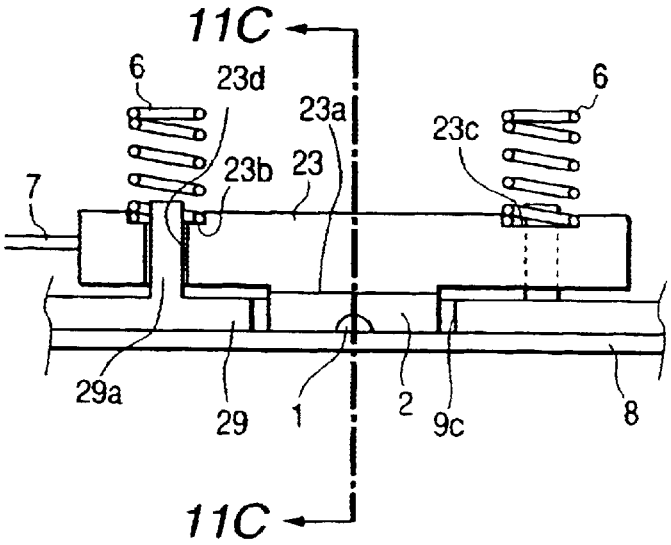
Figure 11C:
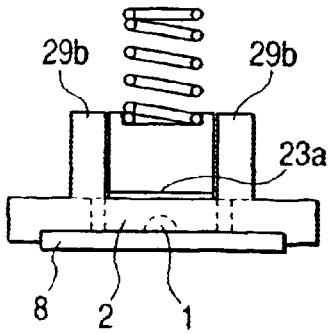
Figure 12A:
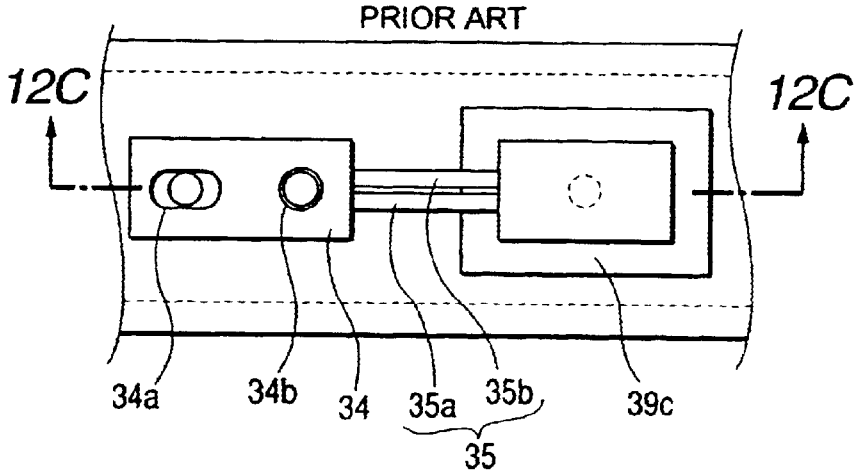
FIG. 12A PRIOR ART
FIGS. 12A, 12B, 12C and 12D show a heating and fixing apparatus in which a conventional temperature detecting device is mounted on a heating member holding member, FIG. 12A being a plan view, FIG. 12B showing the free state of the temperature detecting device, FIG. 12C being a cross-sectional view taken along the line 12C—12C of FIG. 12A, and FIG. 12D being a cross-sectional view taken along the line 12D—12D of FIG. 12C.
Figure 12B:
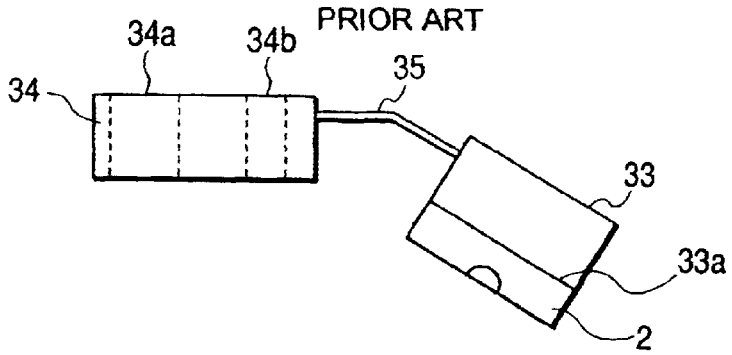
FIG. 12B PRIOR ART
Figure 12C:
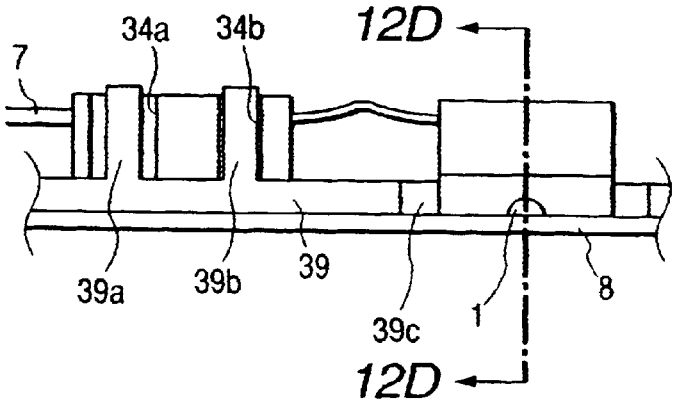
FIG. 12C PRIOR ART
Figure 12D:
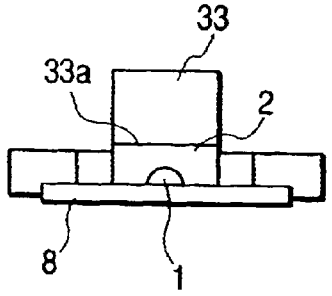
FIG. 12D PRIOR ART
Figure 13:
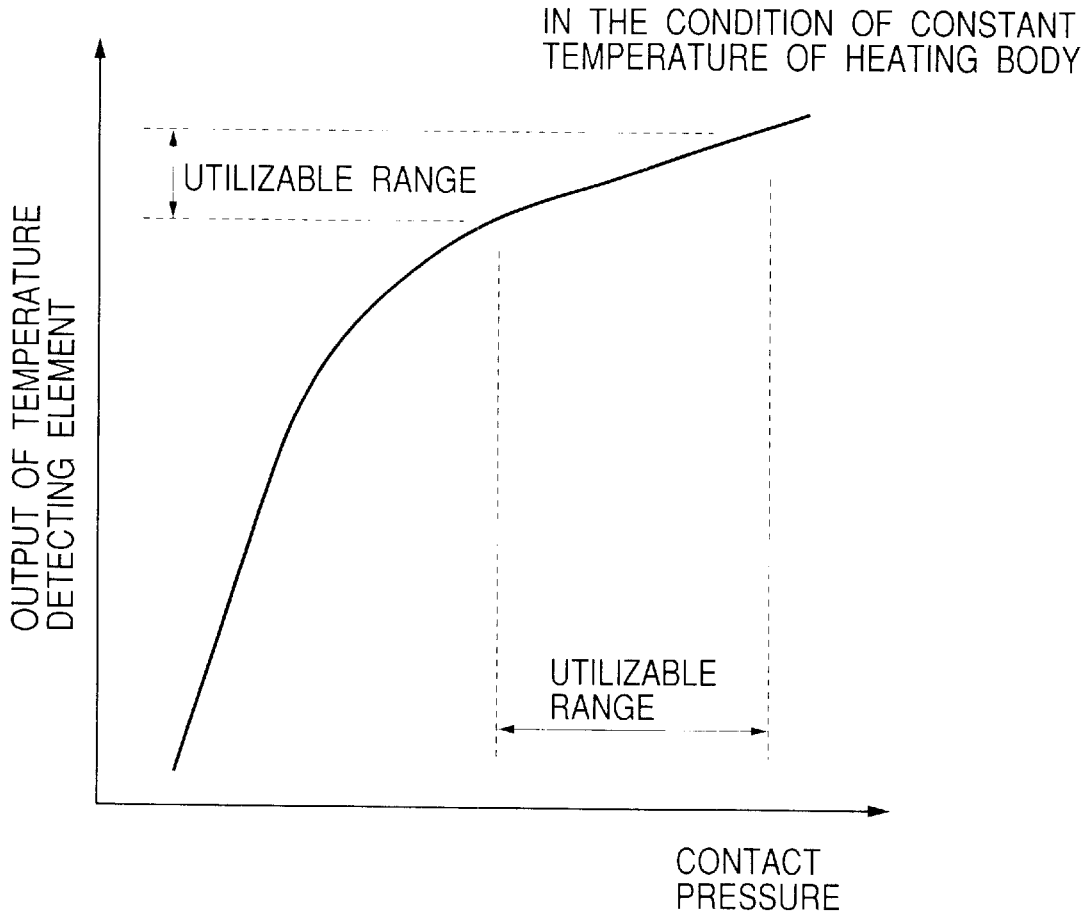
FIG. 13 is a characteristic graph showing the relation between the contact pressure of temperature detecting means with a heater and the detection output thereof.

FIGS. 11A to 11C show a sixth embodiment of the present invention.

FIGS. 11A to 11C show a heating and fixing apparatus in which a temperature detecting device is mounted on a heating member holding member, FIG. 11A being a plan view, FIG. 11B being a cross-sectional view taken along the line 11B—11B of FIG. 11A, and FIG. 11C being a cross-sectional view taken along the line 11C—11C of FIG. 11B.

In FIGS. 11A to 11C, the reference numeral 1 designates a temperature detecting element, the reference numeral 2 denotes a heat-resisting elastic member, the reference numeral 23 designates a temperature detecting element holding member, the reference character 23*a* denotes a temperature detecting element holding surface, the reference characters 23*b* and 23*c* designate spring receiving surfaces, the reference character 23*d* denotes a positioning hole, the reference character 23*e* designates an outer periphery abutting region, the reference numerals 5 and 6 denote compression springs, the reference numeral 7 designates harness, the reference numeral 8 denotes a heating member, the reference numeral 29 designates a heating member holding member, and the reference character 29*a* denotes a projection for positioning the temperature detecting element holding member 23. The reference character 29*b* designates positioning portions formed integrally with the heating member holding member 29, and the positioning portions 29*b* are disposed on the widthwisely opposite sides of the temperature detecting element holding member 23 and effect the positioning of the temperature detecting element holding member 23 in the widthwise direction thereof. These positioning portions 29*b* are provided in accordance with the position at which one compression spring 5 is disposed. In the plan view, the compression springs are omitted.

The difference of the present embodiment from the above-described fifth embodiment is that in the fifth embodiment, a slot into which the projection is inserted is formed in one of the lengthwise ends of the temperature detecting element holding member to thereby effect positioning, whereas in the present embodiment, instead of this slot and the projection, the above-described pair of positioning portions 29*b* abut against one end of the temperature detecting element holding member 23 to thereby effect positioning.

The temperature detecting device in the present embodiment is similar to that in the fourth embodiment and the fifth embodiment in that the radial position of the positioning projection 29*a* is determined by the fitting of the projection 29*a* into the positioning hole 23*d* formed in the other side of the temperature detecting element holding member 23, the upper ends of the compression springs (the sides thereof opposite to the sides thereof biasing the temperature detecting element holding member 23) are fixed by fixing members, not shown, and the compression springs are held with a predetermined action length, whereby the position of the temperature detecting means in the thrust direction thereof is determined.

Depending on the layout of a conductor from the temperature detecting element to the harness, there is a case where the positioning holes cannot be provided as in the fourth embodiment and the fifth embodiment, and there is a case where as in the present embodiment, positioning is effected by the outer periphery.

As shown in FIGS. 11A to 11C, according to the sixth embodiment of the present invention, even a construction in which positioning is effected not by the holes but by the outer periphery of the temperature detecting element holding member 23 can obtain an effect equal to that of the fourth embodiment and the fifth embodiment.

The present invention is not restricted to the above-described embodiments, but covers modifications identical in technical idea therewith.

What is claimed is:

1. An image heating apparatus comprising:

a heater;

temperature detecting means for detecting a temperature of said heater, said temperature detecting means having a temperature detecting element, an elastic member for holding said element, and a film for covering said elastic member; and a holder for holding said heater, said holder having a hole for mounting said temperature detecting means;

wherein the width of said film is smaller than the width of said elastic member, and wherein a gap between an end surface of the hole of said holder and said elastic member is smaller than a gap between the end surface of the hole of said holder and said film.

2. An image heating apparatus according to claim 1, wherein said film of said temperature detecting means is in contact with said heater through the hole of said holder.

3. An image heating apparatus according to claim 1, comprising an inclined surface downwardly extending toward the hole of said holder, around the hole.

4. An image heating apparatus according to claim 1, wherein said elastic member has an inclined surface becoming greater in width away from the hole.

5. An image heating apparatus according to claim 1, wherein said elastic member has a first portion larger than the width of the hole, and a second portion smaller than the width of the hole, and the second portion is opposed to said heater.

6. An image heating apparatus comprising:

a heater;

a holder for holding said heater;

temperature detecting means for detecting a temperature of said heater, said temperature detecting means having a temperature detecting element and a supporting member for supporting said element; and two biasing members for biasing said supporting member toward said heater;

wherein said temperature detecting element detects the temperature of said heater through a hole formed in said holder, and said holder has positioning portions for positioning said supporting member at the right and left of the hole of said holder, and wherein abutting positions of said two biasing members abutting on said supporting member are substantially the same positions as said positioning portions of said holder.

7. An image heating apparatus according to claim 6, wherein said supporting member holds said element through an elastic member.

8. An image heating apparatus according to claim 6, wherein the hole of said holder and said positioning positions at the right and left of the hole are arranged substantially in parallel to the lengthwise direction of said heater.

9. An image heating apparatus according to claim 6, wherein said positioning portions at the right and left of the hole are disposed substantially symmetrically with respect to the hole.

10. An image heating apparatus according to claim 6, wherein said two biasing members are disposed substantially symmetrically with respect to the hole.

11. An image heating apparatus according to claim 6, wherein said positioning portions are projections fitted in holes formed in said supporting member.

12. An image heating apparatus according to claim 6, wherein said positioning portions are projections nipping said supporting member therebetween.

* * * * *

UNITED STATES PATENT AND TRADEMARK OFFICE

CERTIFICATE OF CORRECTION

PATENT NO. : 6,671,471 B2
DATED : December 30, 2003
INVENTOR(S) : Naoki Nakamura et al.

It is certified that error appears in the above-identified patent and that said Letters Patent is hereby corrected as shown below:

Column 9,
Line 41, “deposed” should read -- disposed --.

Signed and Sealed this

Twenty-fifth Day of May, 2004

JON W. DUDAS
*Acting Director of the United States Patent and Trademark Office*